US005550430A

United States Patent [19]

Navaroli et al.

[11] Patent Number: 5,550,430

[45] Date of Patent: Aug. 27, 1996

[54] GAS DISCHARGE CLOSING SWITCH WITH UNITARY CERAMIC HOUSING

[75] Inventors: Henry D. Navaroli; Eugene E. Lednum, both of Williamsport, Pa.

[73] Assignee: Litton Systems, Inc., Beverly Hills, Calif.

[21] Appl. No.: 237,607

[22] Filed: May 16, 1994

[51] Int. Cl.[6] ..... H01J 17/48

[52] U.S. Cl. ..... 313/589; 313/595

[58] Field of Search ..... 313/589, 595, 313/632, 231.31; 361/120

[56] References Cited

U.S. PATENT DOCUMENTS

| | | | |
|---|---|---|---|
| H878 | 1/1991 | Petr et al. | 313/589 |
| 4,498,181 | 2/1985 | Menown et al. | 372/38 |
| 4,888,518 | 12/1989 | Grunwald | 313/231.01 |
| 5,038,082 | 8/1991 | Arita et al. | 313/233 |
| 5,075,594 | 12/1991 | Schumacher et al. | 313/231.31 |
| 5,418,423 | 4/1995 | Murray | 313/589 |

FOREIGN PATENT DOCUMENTS

| | | |
|---|---|---|
| 0417649A2 | 3/1991 | European Pat. Off. . |
| 592266 | 9/1947 | United Kingdom . |
| 672978 | 5/1952 | United Kingdom . |
| 726888 | 3/1955 | United Kingdom . |
| 736343 | 9/1955 | United Kingdom . |
| 773253 | 4/1957 | United Kingdom . |
| 1032447 | 6/1986 | United Kingdom . |

OTHER PUBLICATIONS

"EG&G Research Study", U.S. Signal Corps., p. 191 (1951).

*Primary Examiner*—Sandra L. O'Shea
*Assistant Examiner*—Vip Patel
*Attorney, Agent, or Firm*—Darby & Darby, P.C.

[57] ABSTRACT

A gas discharge closing switch, such as a thyratron, has a one-piece ceramic housing containing an anode, a cathode, and a control electrode. The anode and cathode form fluid-tight seals with opposite ends of the housing. The control electrode is mounted entirely within the housing, and, in one embodiment, is affixed to an interior wall of the housing. The housing preferably supports the anode, the cathode and the control electrode, and maintains electrical isolation between them.

15 Claims, 2 Drawing Sheets

GAS DISCHARGE CLOSING SWITCH WITH UNITARY CERAMIC HOUSING

BACKGROUND OF THE INVENTION

The present invention relates to a gas discharge closing switch and, more particularly, to a thyratron having a unitary ceramic housing.

Gas discharge closing switches, such as thyratrons, are used for rapid switching of high voltage, high current signals with low power consumption. A typical thyratron has an anode connected to high voltage and a cathode held at ground potential. A control electrode or "grid" is placed between the anode and the cathode. Upon application of a positive control pulse, the control electrode closes the switch by drawing electrons from the cathode to transform gas within a housing or "envelope" of the device into a dense, conducting plasma.

Thyratrons generally fall into two classes, depending on whether their housings are made of glass or ceramic material. Although glass thyratrons are suitable in many applications, ceramic is preferred where a device is subjected to substantial external forces. For example, ceramic thyratrons, often referred to as metal/ceramic structures, are used in environments of high acceleration (up to approximately 100 G's) and high vibrational forces (up to 11 G's).

The housings of ceramic thyratrons are typically made from at least two separate ceramic elements, i.e., an upper element between the anode and the control electrode and a lower element between the control electrode and the cathode. The anode is affixed to the top edge of the upper ceramic element and the control electrode is affixed to the bottom edge of the same element. The control electrode is also typically affixed to the top edge of the lower ceramic element and the cathode is affixed to the bottom edge of the lower ceramic element. Each of these attachments must form a fluid-tight or "vacuum" seal in order to maintain the required gaseous environment within the housing. When assembled, the three major electrodes and the two ceramic elements form a stack, alternating between electrodes and ceramic elements. The complexity of this arrangement leads to a variety of difficulties and expenses in manufacturing, however.

Because a portion of the control electrode of a traditional ceramic thyratron is exposed to the air at a location between the anode and the cathode, there is a possibility of arcing from the control electrode to the anode. For this reason, it is necessary to provide a relatively large spacing between the points where the anode and the control electrode structures exit the housing. However, the optimal distance between the anode and the control electrode within the device is generally much smaller than that required to avoid arcing outside. It is therefore necessary to use "deeply drawn" anode and control electrode cups in order to satisfy both of these requirements. Such cups must be drawn two or three times during their manufacture to achieve the required depth, adding significantly to the cost of the device.

All three major electrodes of traditional ceramic thyratrons must also be affixed to the upper and lower ceramic elements in a way that creates a fluid-tight seal. The anode is brazed to the top of the upper ceramic element, the control electrode is brazed to both the bottom of the upper ceramic element and the top of the lower ceramic element, and the cathode is brazed to the bottom of the lower ceramic element, for a total of four vacuum-tight seals. Unfortunately, each braze increases the likelihood that the overall vacuum seal of the housing will fail. Therefore, it is desirable to decrease the number of individual seals, if possible, in order to increase the reliability of the thyratron.

For a thyratron to operate efficiently and reliably, it is also important that the electric field within the device be as uniform as possible. To facilitate this, and to avoid concentrations of the field along electrode edges, the anode and the control electrode must be maintained in precise axial alignment. In the manufacture of traditional thyratrons, all electrodes are aligned relative to the housing through the use of brazing fixtures which are extremely expensive.

In addition, all current flow of a thyratron in the conducting state passes through the control electrode, causing a significant amount of heat to be generated in that region. Much of this heat can be removed by conduction from an existing thyratron along a flange of the control electrode which extends outwardly through the ceramic housing. In fact, the heat generated in metal/ceramic thyratrons is so intense that designers have heretofore considered it essential to conduct it away in this manner. Unfortunately, this requires that the ceramic housing be separated into two or more parts, significantly increasing the cost of the device.

Therefore, it is desirable in many applications to provide a metal/ceramic thyratron design which is simple and less expensive than prior models, yet provides equal or better performance.

SUMMARY OF THE INVENTION

The present invention provides an advantageous gas discharge closing switch having a housing which contains a control electrode and is formed of a single ceramic element. Because the control electrode does not penetrate the housing, two of the troublesome and expensive seals required in prior devices are eliminated. Thus, the number of vacuum brazes is reduced by fifty percent from that of a traditional two-piece ceramic thyratron. Arcing to the anode through the air outside the switch is also avoided because the control electrode is disposed entirely within a unitary ceramic housing. This eliminates the need for deep draw electrode cups. In addition, applicants have discovered that the switch of the present invention does not overheat even though the control electrode is completely encapsulated.

In a preferred embodiment, the control electrode is dimensioned to closely engage the inner surface of the ceramic housing, causing it to expand against that surface and thereby align itself with the housing when heated to brazing temperatures. Hence, the number of required brazing fixtures is reduced from three in a traditional ceramic thyratron (one for each electrode) to two in a switch configured according to the present invention.

Accordingly, a thyratron constructed according to the present invention includes: a unitary ceramic housing for maintaining a gaseous discharge, the housing having open upper and lower ends; an anode structure forming a fluid-tight seal with the upper end of the housing; a cathode structure forming a fluid-tight seal with the lower end of the housing for maintaining a gaseous environment therein; and a control electrode structure disposed within the housing between the anode structure and the cathode structure. In a preferred form, the control electrode structure is disposed entirely within the housing between the upper and lower ends thereof. In another preferred form, the unitary ceramic housing supports the anode, the control electrode and the cathode, and simultaneously maintains electrical isolation between them. In still another form, the anode, the control electrode and the cathode are mutually parallel and coaxial, and the control electrode is affixed to a step defined by the inner surface of the housing.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENTS

Figure 1:
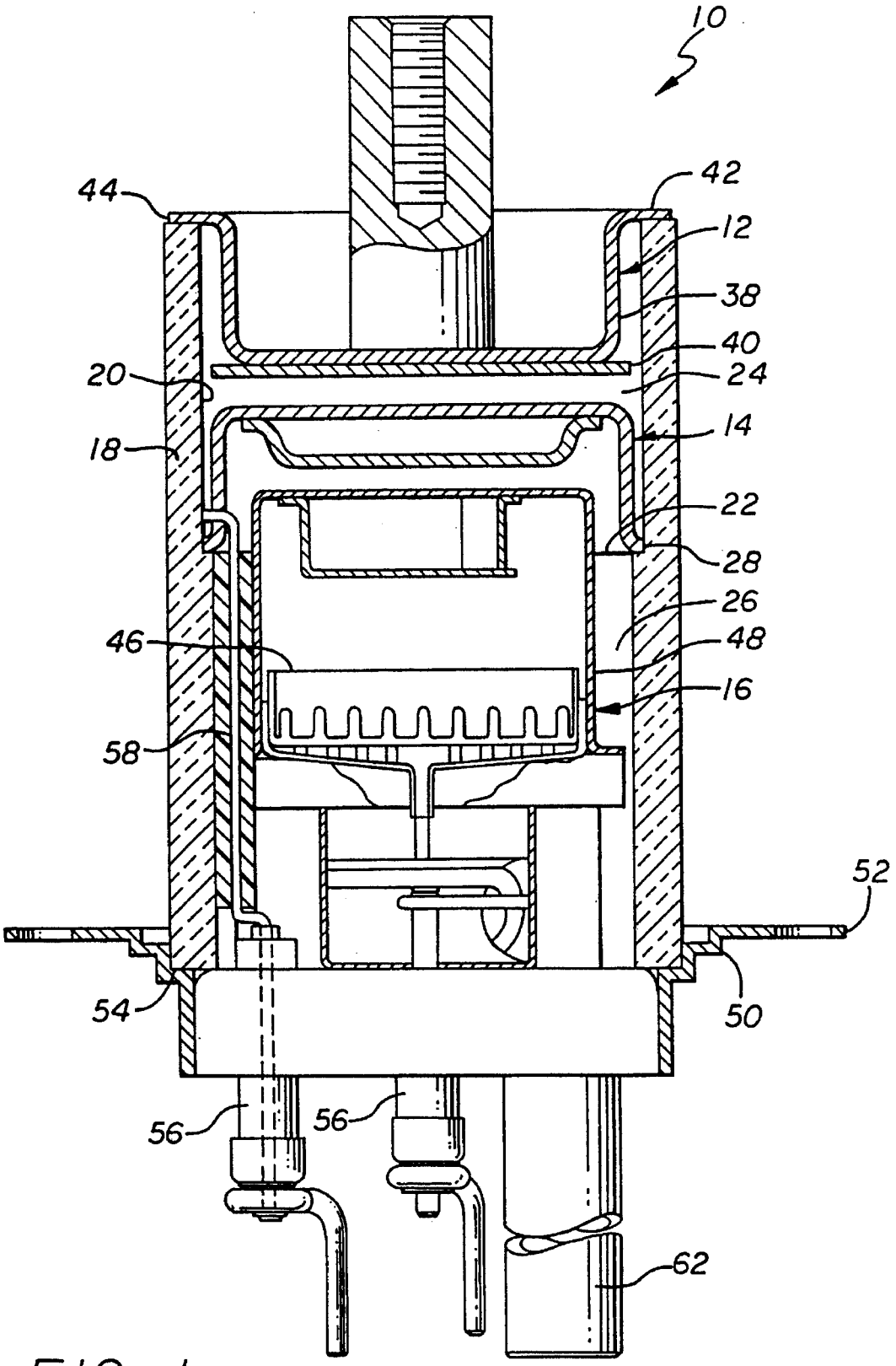
FIG. 1 is a vertical cross-sectional view of a closing switch constructed according to one embodiment of the present invention.

Referring to FIG. 1, a thyratron or other gas discharge closing switch 10 constructed in accordance with the present invention has an anode structure 12, a control electrode structure, or "grid", 14, and a cathode structure 16, all of which are supported relative to a one-piece ("unitary") ceramic housing 18. The control electrode structure 14 is preferably located entirely within the ceramic housing 18 between the anode structure 12 and the cathode structure 16, as illustrated in FIG. 1, and does not penetrate the housing. This configuration avoids the cost and reliability issues inherent in multiple ceramic housing elements and in vacuum seals between a control electrode structure and a ceramic housing. It also eliminates the need for deeply drawn anode and control electrode cups.

In the illustrated embodiment, the housing 18 is substantially cylindrical and has an interior surface 20 with a step 22 which serves as a transition between a first interior surface portion 24 and a second interior surface portion 26 thereof. The step 22 supports a bottom edge 28 of the control electrode structure 14 to locate the control electrode structure within the ceramic housing.

Figure 2:
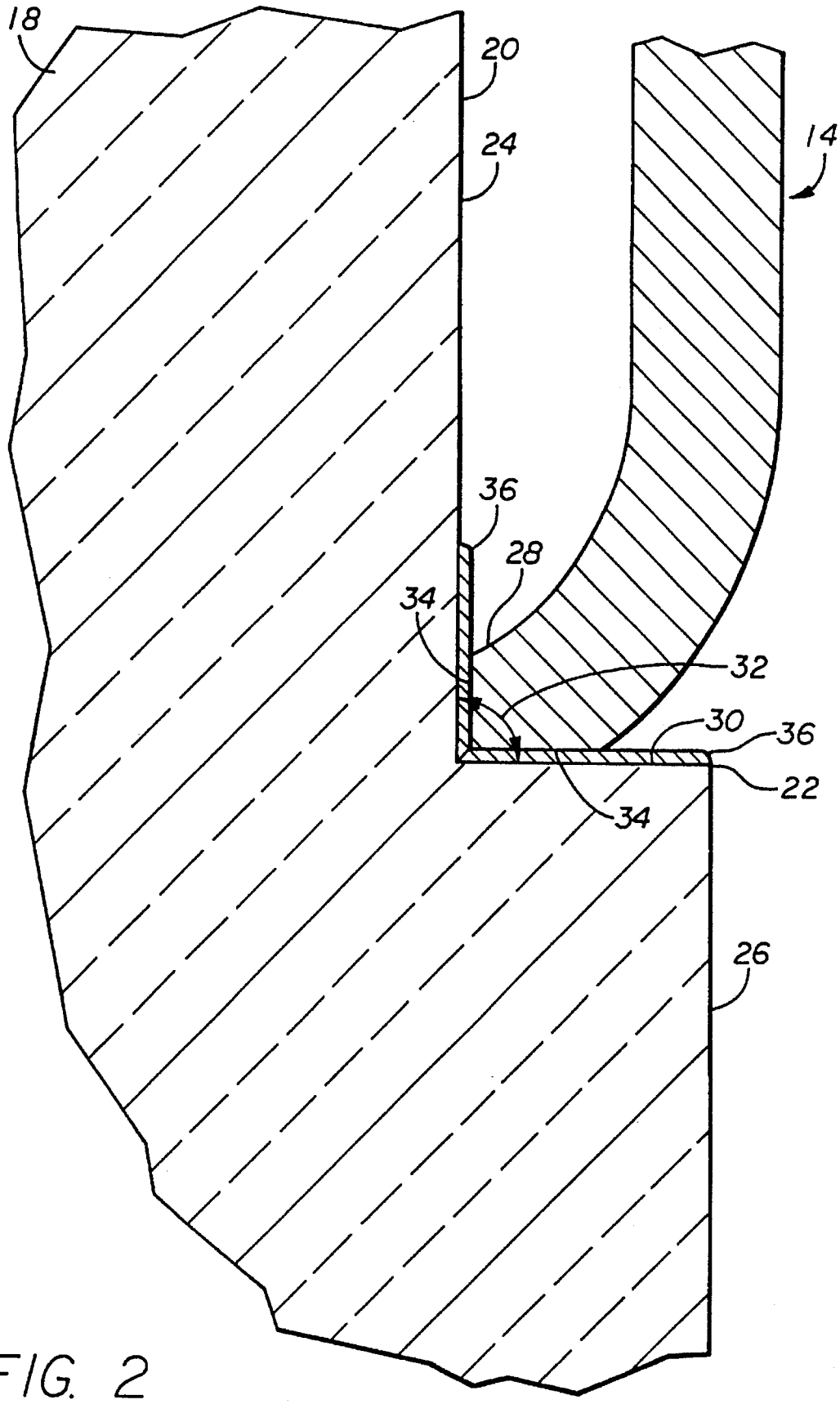
FIG. 2 is an enlarged fragmentary sectional view showing attachment of the control electrode of the closing switch of FIG. 1 to the inside surface of an associated ceramic housing.

Referring now to FIG. 2, the step 22 includes a substantially radially-directed segment 30 of the interior surface 20 which extends from the first interior surface portion 24 to the second interior surface portion 26 and defines an interior angle 32 with the first surface portion 24. This angle, which is preferably ninety (90) degrees, receives the bottom edge 28 of the control electrode structure.

In the disclosed embodiment, the bottom edge 28 of the control electrode structure has two flattened surface segments 34 for bonding to the first interior surface portion 24 and the radial segment 30 of the housing. Bonding is preferably accomplished by brazing to appropriate metallized coatings 36 on the housing surface. When the control electrode structure is made of copper, the metallized coatings 36 may, for example, be formed by firing a moly-manganese mixture into the surface of the ceramic housing 18 and later plating nickel over the impregnated region. This connects the control electrode structure 14 securely to the ceramic housing along two substantially perpendicular surfaces, creating a bond secure enough to withstand high external forces. Advantageously, the control electrode structure expands sufficiently during the brazing process to force itself against the interior surface 20 and thereby align itself with the axis of the housing. Thus, no special jigging fixture of any type is required to achieve accurate alignment of the control electrode.

Because the control electrode does not extend outside the ceramic housing 18 and contact the air, it is not necessary to separate the edges of the control electrode structure 14 and the anode structure 12 by a great distance. The step 22 can therefore be placed at any convenient height within the housing, permitting shallowly drawn metal cups to be used for the control electrode structure 14 and the anode structure 12. In this context, "shallowly drawn" means that each cup can be formed from a single piece of stock in a single drawing operation, as distinguished from prior ceramic thyratrons in which anode and control electrodes require two or more drawing steps. For copper stock having an initial thickness of 0.036 inches (0.9 mm), such cups have a height less than one inch (2.54 cm), and preferably no more than one-half inch (1.27 cm).

Referring again to FIG. 1, the anode structure 12 may have an anode cup 38 with a horizontal anode plate 40 at its lower end. The anode cup, which is preferably made of copper, has an upper flange 42 brazed or otherwise affixed directly to an open upper end 44 of the housing 18 to form a fluid-tight seal. An external jigging fixture is preferably used in the brazing operation to assure accurate axial alignment of the anode structure 12.

The cathode structure 16 is made up of a cathode 46 and a cathode heat shield 48, both supported within the unitary ceramic housing 18 on a cathode base plate 50. The cathode base plate 50 is preferably made of a suitable conductor, such as copper, and has a flange 52 for mounting of the thyratron 10. The cathode base plate 50 is bonded directly to a lower end 54 of the ceramic housing, preferably by brazing, to provide a fluid-tight seal at that location. This process can be performed without a high precision jigging fixture, though, because axial alignment of the cathode structure 16 is much less critical than that of the anode structure 12 and the control electrode structure 14. The cathode structure 16 is also provided with a plurality of fluid-tight bushings 56 extending through its base plate 50 to connect the interior of the housing 18 to the outside world. Electrical connection to the control electrode structure 14 is preferably made by an insulated lead 58 extending through one of the bushings 56.

The one-piece ceramic housing 18 is filled with a suitable plasma-forming gas, such as hydrogen, and is then sealed off from the atmosphere. A suitable gas reservoir 60 of conventional design is provided within the housing 18 to maintain the gas pressure at a preselected optimal level. In addition, a tube 62 extends through the cathode base plate 50 for evacuation and back-filling of the device during the manufacturing process.

The unique construction of the thyratron 10, including its one-piece ceramic housing 18, simplifies the manufacturing process by reducing the number of fluid-tight brazes or other bonding operations that must be performed. Because the control electrode 16 is located entirely within the housing, it need not be connected to the housing in a fluid-tight manner. It is necessary only that the bond between the flattened surface segments 34 of the control electrode and the metallized coatings 36 of the housing be mechanically sound. Likewise, manufacture of the ceramic housing is simplified because only its exterior surface and the counterbored first interior surface portion 24 must be machined to close tolerances. The second interior surface portion 26, which is smaller in diameter than the first, can be left in "as fired" condition with no ill effects. In addition, as noted above, the anode structure and the control electrode structure need not be deep drawn. All of the foregoing features combine to render the structure of the closure switch 10 significantly less expensive to manufacture than prior ceramic closure switches without adversely affecting performance or reliability.

In operation, a high positive voltage is applied to the anode structure 12 and the cathode structure 16 is grounded. The control electrode structure 14 is either grounded or maintained at a small negative potential to repel electrons emitted by the cathode structure 16 in the "open" condition of the switch. Substantially all of the voltage across the switch 10 is therefore present between the anode structure 12 and the control electrode structure 14 in the open condition, but breakdown does not occur because of the absence of free carriers and the small spacing between these components. When a positive pulse is applied to the control electrode structure 14, electrons are drawn from the cathode structure 16, which is preferably coated with a thermionic coating and heated to a temperature of approximately 800° C., to ionize the gas within the housing 18 and create a plasma of highly energized gas species. As the electrons and other charge carriers travel through the gas, they collide with gas molecules and set up an avalanche ionization process which results in a dense conducting plasma throughout the interior of the housing 18.

The thyratron 10 returns to its nonconducting state only when the anode voltage is removed for a time sufficient to allow the charged particles of the plasma to recombine. This period is known as the "recovery time" of the device. After the recovery period, the grid potential returns to its original (typically negative) value and a positive voltage can be applied to the anode structure 12 without conduction taking place. The thyratron 10 is then ready to fire in response to the next positive control pulse.

While certain specific embodiments have been disclosed as typical, the invention is not limited to these particular forms, but rather is applicable broadly to all such variations as fall within the scope of the appended claims.

What is claimed is:

1. A gas discharge closing switch comprising:

a unitary ceramic housing for maintaining a gaseous discharge, the unitary ceramic housing having upper and lower ends;

an anode structure forming a fluid-tight seal with the upper end of the unitary ceramic housing;

a cathode structure forming a fluid-tight seal with the lower end of the unitary ceramic housing;

a control electrode structure disposed within the unitary ceramic housing, the control electrode structure being interposed between the anode structure and the cathode structure; and an electrically conductive path extending from the control electrode structure to said lower end for application of control signals to said control electrode structure.

2. The gas discharge closing switch of claim 1 wherein:

the unitary ceramic housing supports the anode structure, the control electrode structure and the cathode structure, and maintains electrical isolation between them.

3. The gas discharge closing switch of claim 1 wherein:

the control electrode structure is disposed entirely within the unitary ceramic housing between said upper and lower ends.

4. The gas discharge closing switch of claim 1 wherein:

the control electrode structure is affixed to an interior surface of the unitary ceramic housing.

5. The gas discharge closing switch of claim 4 wherein:

the unitary ceramic housing has an interior surface forming a step to which the control electrode structure is affixed.

6. The gas discharge closing switch of claim 5 wherein:

said step comprises at least two substantially perpendicular portions of said interior surface defining an interior angle; and the control electrode structure is affixed to both of said substantially perpendicular portions.

7. The gas discharge closing switch of claim wherein: the control electrode structure is brazed to both of said substantially perpendicular portions.

8. The gas discharge closing switch of claim 1 wherein:

the unitary ceramic housing is substantially cylindrical.

9. The gas discharge closing switch of claim 1 wherein:

the anode structure, the cathode structure and the control electrode structure are coaxial with the unitary ceramic housing.

10. The gas discharge closing switch of claim wherein:

at least one of the anode structure, the cathode structure, and the control electrode structure is brazed to the unitary ceramic housing.

11. The gas discharge closing switch of claim 1 wherein:

the anode structure comprises a metal cup less than one inch in depth.

12. The gas discharge closing switch of claim wherein:

the control electrode structure comprises a metal cup one-half inch or less in depth.

13. The gas discharge closing switch of claim 6 wherein:

the control electrode structure further comprises at least one baffle between the anode structure and the cathode structure.

14. The gas discharge closing switch of claim 1, further comprising:

one or more cathode shield structures located between the cathode structure and the control electrode structure.

15. A gas discharge closing switch comprising:

a unitary ceramic housing for maintaining a gaseous discharge, the unitary ceramic housing being cylindrical and having open upper and lower ends and an interior surface forming a step;

an anode structure forming a fluid-tight seal with the upper end of the unitary ceramic housing;

a cathode structure forming a fluid-tight seal with the lower end of the unitary ceramic housing for maintaining a gaseous environment within the housing;

a control electrode structure disposed within the unitary ceramic housing, the control electrode structure being interposed between the anode structure and the cathode structure and bonded to portions of said interior surface forming said step; and an electrically conductive path extending from the control electrode structure to said lower end for application of control signals to said control electrode structure.

* * * * *